US010294948B2

(12) United States Patent
Alvini

(10) Patent No.: US 10,294,948 B2
(45) Date of Patent: May 21, 2019

(54) AXIAL VENTILATION DEVICE, PREMISES EQUIPPED WITH SUCH A DEVICE

(71) Applicant: TOTAL SA, Courbevoie (FR)

(72) Inventor: Gérard Alvini, Pau (FR)

(73) Assignee: Total SA, Courbevoie (FR)

( * ) Notice: Subject to any disclaimer, the term of this patent is extended or adjusted under 35 U.S.C. 154(b) by 389 days.

(21) Appl. No.: 15/027,204

(22) PCT Filed: Sep. 30, 2014

(86) PCT No.: PCT/FR2014/052467
§ 371 (c)(1),
(2) Date: Apr. 4, 2016

(87) PCT Pub. No.: WO2015/049457
PCT Pub. Date: Apr. 9, 2015

(65) Prior Publication Data

US 2016/0245293 A1 Aug. 25, 2016

(30) Foreign Application Priority Data

| | | |
|---|---|---|
| Oct. 3, 2013 | (EP) | 13306376 |
| Oct. 23, 2013 | (FR) | 13 60311 |
| Apr. 3, 2014 | (FR) | 14 52941 |

(51) Int. Cl.
*F24F 7/06* (2006.01)
*F04D 19/00* (2006.01)
(Continued)

(52) U.S. Cl.
CPC ..... *F04D 25/163* (2013.01); *F04D 19/002* (2013.01); *F04D 25/02* (2013.01);
(Continued)

(58) Field of Classification Search
CPC .... F04D 25/163; F04D 25/166; F04D 19/002; F04D 19/007; F04D 19/024; F04D 25/02;
(Continued)

(56) References Cited

U.S. PATENT DOCUMENTS 308,151 A 11/1884 Frey
3,628,350 A * 12/1971 Ruth ..... F24F 1/02 165/127

(Continued)

FOREIGN PATENT DOCUMENTS

CN 2793377 Y 7/2007
DE 20 2012004313 U1 8/2012

(Continued)

OTHER PUBLICATIONS

International Search Report with English translation for PCT/FR2014/052467, dated Dec. 16, 2014, 4 pages.

(Continued)

*Primary Examiner* — Carlos A Rivera
*Assistant Examiner* — Justin A Pruitt
(74) *Attorney, Agent, or Firm* — Patterson Thuente Pedersen, P.A.

(57) ABSTRACT

The invention relates to an axial ventilation device comprising at least three axial fans disposed at the ends of a polygon. According to the invention, a single drive shaft is adapted to rotate at least the shafts of two axial fans. The invention also relates to a premises equipped with such an axial ventilation device.

14 Claims, 3 Drawing Sheets

(51) Int. Cl.

| | |
|---|---|
| ***F04D 25/02*** | (2006.01) |
| ***F04D 25/08*** | (2006.01) |
| ***F04D 25/16*** | (2006.01) |
| ***F04D 29/32*** | (2006.01) |
| ***F04D 25/06*** | (2006.01) |
| ***F04D 29/52*** | (2006.01) |
| ***F24F 7/013*** | (2006.01) |

(52) U.S. Cl.
CPC ..... *F04D 25/06* (2013.01); *F04D 25/08* (2013.01); *F04D 25/166* (2013.01); *F04D 29/325* (2013.01); *F04D 29/522* (2013.01); *F24F 7/013* (2013.01); *F24F 7/06* (2013.01)

(58) Field of Classification Search
CPC ..... F04D 25/06; F04D 25/0606; F04D 25/08; F04D 29/325; F04D 29/522; F24F 7/013; F24F 7/06; F24F 7/065
USPC ..... 415/122.1
See application file for complete search history.

(56) References Cited

U.S. PATENT DOCUMENTS

| | | | | |
|---|---|---|---|---|
| 2006/0226281 | A1* | 10/2006 | Walton | B64C 27/20 244/17.23 |
| 2009/0159352 | A1 | 6/2009 | Huang et al. | |
| 2009/0175745 | A1* | 7/2009 | Usami | F01P 5/04 417/426 |
| 2010/0111697 | A1* | 5/2010 | Wood | F01D 1/24 416/128 |
| 2013/0284608 | A1* | 10/2013 | Blake | F03D 15/10 205/464 |

FOREIGN PATENT DOCUMENTS

| | | | |
|---|---|---|---|
| GB | 700684 | A | 12/1953 |
| JP | 2007 303286 | A | 11/2007 |
| WO | WO 2011/089578 | A2 | 7/2011 |

OTHER PUBLICATIONS

FR Search Report for FR 13 60311, dated Aug. 7, 2014, 7 pages.
FR Search Report for FR 1452941, dated Dec. 9, 2014, 7 pages.

* cited by examiner

AXIAL VENTILATION DEVICE, PREMISES EQUIPPED WITH SUCH A DEVICE

RELATED APPLICATIONS

The present application is a National Phase entry of PCT Application No. PCT/FR2014/052467, filed Sep. 30, 2014, which claims priority from EP Patent Application No. 13306376.8, filed Oct. 3, 2013, and which claims priority from FR Patent Application No. 13 60311, and which claims priority from FR Patent Application No. 1452941, said applications being hereby incorporated by reference herein in their entirety.

FIELD OF THE INVENTION

The present invention relates to an axial ventilation device and to the applications thereof. In the context of the present invention, an "axial ventilation device" means a device comprising a plurality of axial fans.

BACKGROUND OF THE INVENTION

A fan is a turbomachine which transfers energy to a gas passing through it so that this gas can be conveyed, for example through a wall, into one or more pipes, or alternatively so as to sweep a space, notably to ensure the uniformity thereof a fan is made up of blades fixed to a hub, the assembly forming an impeller, in which said hub is driven by a motor; fan classes are usually defined according to the type of impeller, these differing from one another in terms of the shape of the blades.

What is meant by an "axial fan" is a fan in which the vanes are of helicoid shape and in which the direction in which the gas flows is essentially axial; these fans are also known as "axial-flow fans".

Axial fans are notably suited to stirring a gas in high-volume premises or to extracting gases through walls; they may also be mounted inside a duct. An axial fan comprises a case ring which is a static part, fixed directly or by means of intermediate components to a building or to some equipment; the case ring exhibits symmetry of revolution extending along a longitudinal axis. This axis will be referred to hereinafter as the "axis of the fan". The case ring may be of substantially cylindrical or substantially frustoconical shape; part of the duct may constitute the case ring of an axial fan; the two ends of the case ring, which are substantially perpendicular to the axis of the fan, comprise an opening to allow the passage of the gas. An axial fan also comprises blades, also referred to as vanes, fixed to a hub extending along the axis of the fan. Said hub is driven by a motor. The gas is thus driven essentially along the axis of the fan, inside the case ring.

Usually, the motor of an axial fan is positioned inside the case ring, along the axis of the fan. The gas thus moves in the space lying between the internal wall of the case ring and the external wall of the motor.

This results in a loss of pressure head caused by the motor taking up space inside the case ring.

Moreover, the requirements for securing (making safe) industrial equipment are ever increasing and the risks associated with contact between electrical installations and gases, notably explosive gases, need to be carefully taken into consideration. It is therefore appropriate to use special motors, referred to as explosion proof. This results in a significant on-cost.

SUMMARY OF THE INVENTION

The present invention is aimed at an axial ventilation device comprising a plurality of axial fans, in which each axial fan comprises a case ring exhibiting symmetry of revolution extending longitudinally along an axis of the fan, blades arranged inside the case ring and fixed to a hub, a shaft of the axial fan to which the hub is secured, said shaft extending along the axis of the axial fan, at least one motor designed to drive a drive shaft in rotation about the axis of rotation of said motor, in which the motor(s) is (are) situated on the outside of the case ring and the drive shaft(s) is (are) connected to the shaft of the axial fan by a coupling device so as to perform the rotary driving of the shaft of the axial fan. The axial ventilation device may comprise at least three axial fans arranged at the ends of a polygon and that one and the same drive shaft is designed to drive the rotation of at least the shafts of two axial fans.

It is thus possible to create a network of axial fans joined together; this for example makes it possible to increase the level of safety of a ventilation device.

It also results in an improvement in the ventilation capabilities.

The choice of such an axial fan is advantageous because the space occupied by the motor is now moved out of the case ring. It is thus possible to reduce the size of an axial fan and/or to increase the ventilation efficiency thereof by comparison with an axial fan arranged inside the case ring.

Moreover, choosing such an axial fan makes it possible, at least in part, to circumvent the constraints associated with the use of explosive gases, notably known as "ATEX" gases (which refers to "explosive atmospheres"), because the gas no longer encounters any electrical devices in its path. It is thus possible to use motors that are not as expensive as explosion proof motors.

The present invention is also aimed at an axial ventilation device further comprising the features listed in the following embodiments, which may be combined with one another in any technically feasible configuration:

- the coupling device for at least one axial fan comprises a gear set device (70) between the shaft of the axial fan and a shaft of the (or each of the) motor(s);
- the gear set device of at least one axial fan, between the shaft of the axial fan and the shaft of a motor, is a bevel gear set forming an angle transmission, for example a 90° angle transmission;
- the motor(s) of at least one axial fan is (are) arranged in such a way that the angle between the axis of the axial fan and the axis of rotation of the motor is substantially 90° or 270°;
- the hub of at least one axial fan is driven by two motors the axes of rotation of which are arranged in one and the same plane perpendicular to the axis of the axial fan;
- the hub of at least one axial fan is made of aluminum and the shaft of the axial fan is made of steel;
- the blades of at least one axial fan are arranged inside the case ring in two rows each situated in a plane perpendicular to the axis of the axial fan and in which the two rows of blades rotate in opposite directions by virtue of two coaxial shafts of the axial fan;
- the external ends of the two coaxial shafts of at least one axial fan are arranged respectively in an inlet bullet and in an outlet bullet and the internal ends of the two coaxial shafts are connected to the coupling device so as to allow them to rotate in two opposite directions;

the drive shaft of at least one axial fan passes through the motor longitudinally and extends to meet both a first axial fan and a second axial fan;

the polygon is chosen from the list consisting of a triangle, a square, a rectangle, a hexagon, an octagon;

each axial fan comprises two motors and each of these motors is connected to another axial fan so as to form a network;

each axial fan of the axial ventilation device is identical;

each of the axial fans of the device is arranged at one end of the polygon.

The present invention is also aimed at a premises equipped with at least one axial ventilation device according to any one of the embodiments of the present invention listed hereinabove.

The present invention is also aimed at the use of at least one axial ventilation device according to any one of the embodiments of the present invention listed hereinabove, for transferring energy, under very cold weather conditions, to a gas passing through it (them). What is meant by "very cold" weather conditions is weather conditions in which the outside temperatures are below or equal to −40° C., notably below or equal to −50° C. These conditions are notably encountered in arctic environments.

BRIEF DESCRIPTION OF THE DRAWINGS

The following examples illustrate the present invention without, however, limiting same.

The invention will be better understood if reference is made to the attached drawings in which.

It should be noted that the components of the embodiments depicted are not necessarily drawn to scale and that the sole purpose of the figures is to make the present invention easier to understand. The same numerical references correspond to the same components in all the figures.

DETAILED DESCRIPTION OF THE DRAWINGS

Figure 1:
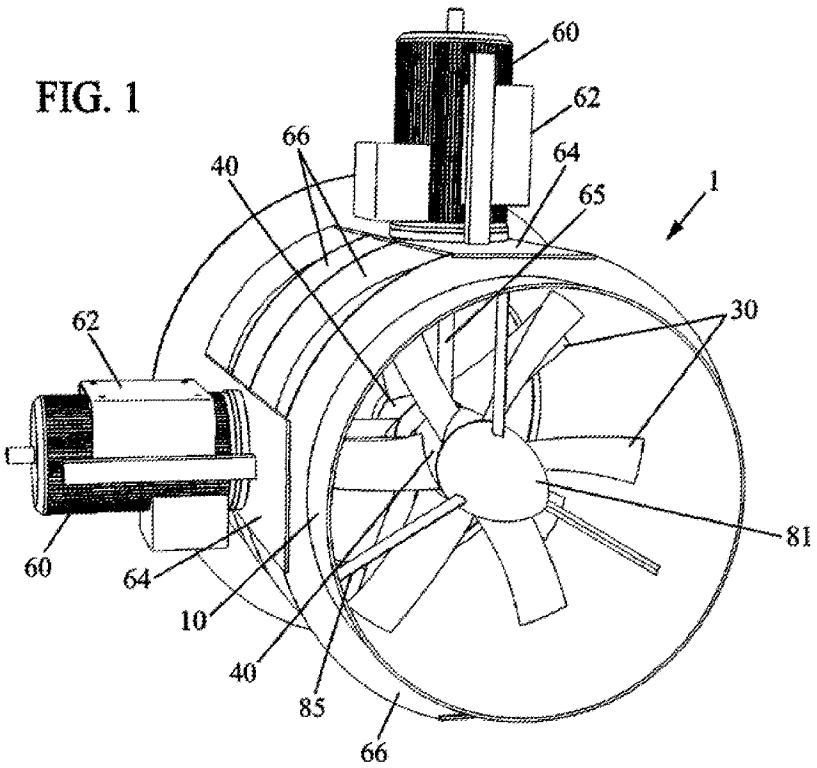
FIGS. 1 and 2 schematically depict one and the same embodiment of an axial fan that can be used in an axial ventilation device according to the present invention, as a perspective view and a partially exploded front elevation, respectively.
Figure 2:
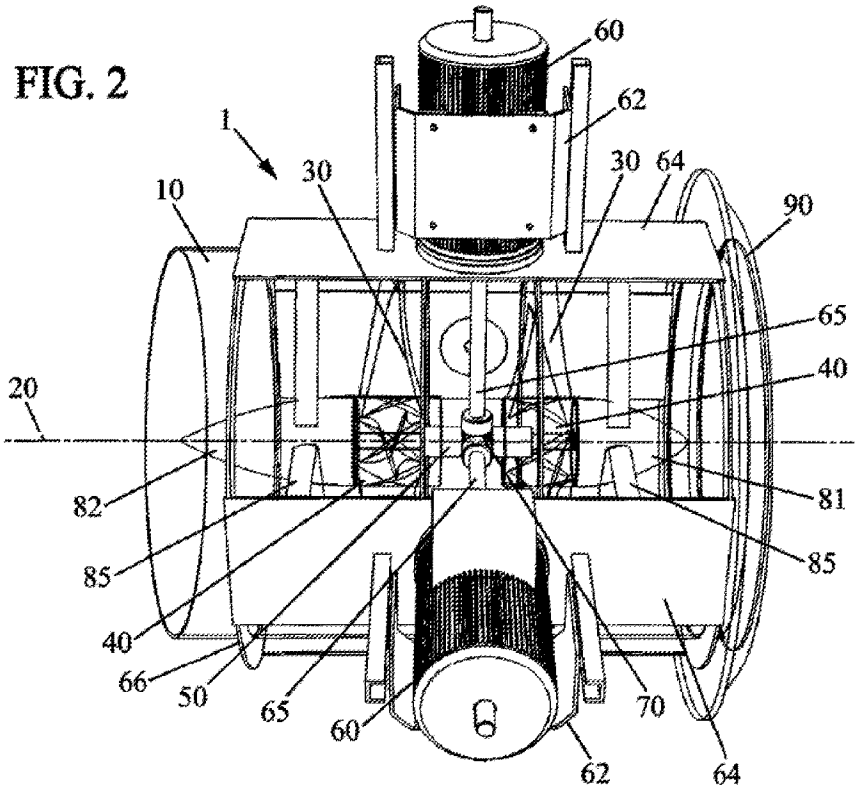

FIGS. 1 and 2 schematically depict an axial fan 1 comprising a case ring 10 (also usually known as the "volute casing") exhibiting symmetry of revolution extending longitudinally along an axis 20. In the case depicted, the case ring is cylindrical, in the form of a cylinder of revolution. The case ring is intended to be fixed directly or via suitable components to a structure, notably to a part of a building, for example to a wall or to a roof.

According to one embodiment, the axial fan 1 is situated inside a building and allows a stream of gas to be moved around within this building.

According to another embodiment, the axial fan 1 is situated in a part of a building at the interface between the inside of the building and the outside of the building; it thus allows a stream of gas to move from inside this building to outside this building.

In the context of the present invention, a component situated between the axis 20 and the case ring 10 will be qualified as being situated "inside" the axial fan and a component situated beyond the case ring 10 when considering an axis passing through the axis 20 and situated in a plane perpendicular to the axis 20 will be considered to be situated "outside" the axial fan.

The "inlet" is the zone situated upstream of the axial fan in the sense of the direction in which the gas flows and the "outlet" is the zone situated downstream of the axial fan in the sense of the direction in which the gas flows. In the diagram of FIG. 2, the inlet is situated to the right of the axial fan and the outlet is situated to the left of the axial fan.

It should be noted that the case ring 10 is depicted only in part in FIG. 2 in order notably to make the components situated inside the axial fan and described hereinafter clearly visible.

The axial fan comprises blades 30 arranged inside the case ring and fixed to a hub 40. A shaft 50 is secured to the hub 40 of the axial fan; this shaft 50 extends along the axis 20 of the axial fan. According to one embodiment, the hub 40 is made of aluminum and the shaft 50 of the axial fan is made of steel. The blades have rotational mobility with respect to the case ring and are driven by the shaft 50.

The axial fan depicted comprises two motors 60 designed each to drive a drive shaft 65 in rotation about the axis of rotation of said motor; the motors are situated on the outside of the case ring and the two drive shafts are connected to the shaft 50 of the axial fan by a coupling device 70 so as to perform the rotary driving of the shaft of the axial fan. The two motors 60 are arranged in such a way that the angle between the axis of the axial fan and the axis of rotation of the motor is 90°; the axes of rotation of these two motors 60 are arranged in one and the same plane perpendicular to the axis of the axial fan.

The coupling device depicted is a gear set device 70 between the shaft 50 of the axial fan and each shaft 65 of the motors 60, made up of a bevel gear set forming a 90° angle transmission. This bevel gear set comprises two bevel gears fixed to the shaft 50 of the axial fan and arranged at 90°; each drive shaft 65 comprises one bevel gear intended to mesh with a bevel gear fixed to the shaft 50 of the axial fan. Each shaft 65 of the motors 60 may be coupled or uncoupled with respect to the bevel gears fixed to the shaft 50. As a result, the shaft 50 of the axial fan can be driven by either by one of the two motors 60 or by both of the two motors 60 simultaneously.

The axial fan depicted comprises two rows of blades each situated in a plane perpendicular to the axis 20 of the axial fan; these two rows of blades rotate in opposite directions by virtue of two coaxial shafts of the axial fan. This then achieves a fan of the so-called "contrarotating" type.

The external ends of the two coaxial shafts of the axial fan are arranged respectively in an inlet bullet 81 and in an outlet bullet 82 and the internal ends of the two coaxial shafts are connected to the coupling device in such a way as to allow them to rotate in two opposite directions.

The inlet bullet 81 and the outlet bullet 82 are each connected and secured to the case ring 10 by three pylons 85.

The axial fan depicted further comprises a profiled convergent nozzle 90 located at the inlet.

The case ring 10 is surrounded by a plurality of annular plates 66, secured to said case ring, arranged in a plane perpendicular to the axis 20 and making it possible to support two plates 64 on which the two motors 60 are positioned; fixings 62 allow each of these motors to be held on the plates 64.

Figure 3:
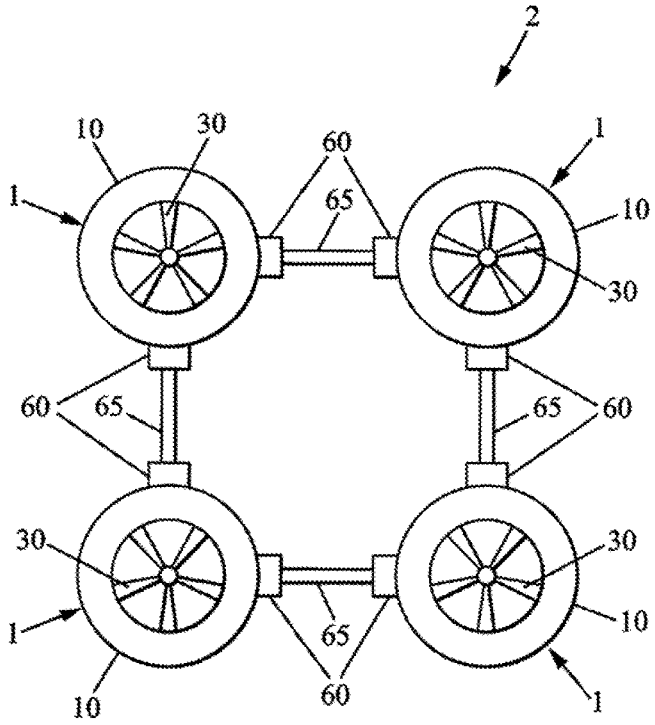
FIG. 3 schematically depicts an axial ventilation device according to the present invention.

FIG. 3 schematically depicts an axial ventilation device 2 according to the present invention, comprising a plurality of axial fans 1, for example as illustrated in FIGS. 1 and 2 and described hereinabove, in which one and the same drive shaft 65 is designed to drive the rotation of the shafts of two axial fans 1. The drive shaft 65 passes longitudinally through the motor and extends to meet both a first axial fan and a second axial fan. The axes of the motors are situated in one and the same plane perpendicular to the axis 20 depicted in FIG. 2.

In the example depicted, the axial ventilation device comprises four axial fans 1 arranged at the ends of a polygon of square shape. Each axial fan comprises two motors 60 and each of these motors 60 is connected to another axial fan so as to form a square network.

This setup is advantageous in terms of the safety of the device. This is because should one motor of an axial fan fail, it is possible for this axial fan to be driven using another motor of another axial fan and to continue to operate the axial ventilation device. It is also thus easily possible to change a motor without shutting the device down.

Moreover, the inventors have been able to demonstrate that it is possible to replace the set of 32 fans set out in one embodiment described in patent application WO2011/089578 (the example mentioned on pages 11 to 13 and corresponding to FIGS. 1 to 3) with an axial ventilation device according to the embodiment described above and corresponding to FIG. 3. This results in very significant savings.

Such an axial ventilation device may be provided to premises comprising industrial equipment, for example comprising for transferring energy, under very cold weather conditions, to a gas passing through it (them).

The embodiments above are intended to be illustrative and not limiting. Additional embodiments may be within the claims. Although the present invention has been described with reference to particular embodiments, workers skilled in the art will recognize that changes may be made in form and detail without departing from the spirit and scope of the invention.

Various modifications to the invention may be apparent to one of skill in the art upon reading this disclosure. For example, persons of ordinary skill in the relevant art will recognize that the various features described for the different embodiments of the invention can be suitably combined, un-combined, and re-combined with other features, alone, or in different combinations, within the spirit of the invention. Likewise, the various features described above should all be regarded as example embodiments, rather than limitations to the scope or spirit of the invention. Therefore, the above is not contemplated to limit the scope of the present invention.

The invention claimed is:

1. An axial ventilation device comprising at least three axial fans arranged at the ends of a polygon and each axial fan includes two motors and each of these motors is connected to another axial fan so as to form a network wherein each axial fan comprises a case ring exhibiting symmetry of revolution extending longitudinally along an axis of the fan, a plurality of blades arranged inside the case ring and fixed to a hub, a shaft of the axial fan to which the hub is secured, said shaft extending along the axis of the axial fan, at least one motor designed to drive a drive shaft in rotation about the axis of rotation of said motor, in which the motor is situated on the outside of the case ring and the drive shaft is connected to the shaft of the axial fan by a coupling device so as to perform the rotary driving of the shaft of the axial fan, in which said axial ventilation device is further characterized in that one and the same drive shaft is designed to drive the rotation of at least the shafts of two axial fans.

2. The axial ventilation device as claimed in claim 1, in which the coupling device for at least one axial fan comprises a gear set device between the shaft of the axial fan and a shaft of the motor.

3. The axial ventilation device as claimed in claim 1, in which the gear set device of at least one axial fan, between the shaft of the axial fan and the shaft of a motor, is a bevel gear set forming an angle transmission.

4. The axial ventilation device as claimed in claim 1, in which the motor of at least one axial fan is arranged in such a way that the angle between the axis of the axial fan and the axis of rotation of the motor is substantially 90° or 270°.

5. The axial ventilation device as claimed in claim 1, in which the hub of at least one axial fan is driven by two motors the axes of rotation of which are arranged in one and the same plane perpendicular to the axis of the axial fan.

6. The axial ventilation device as claimed in claim 1, in which the hub of at least one axial fan is made of aluminum and the shaft of the axial fan is made of steel.

7. The axial ventilation device as claimed in claim 1, in which the blades of at least one axial fan are arranged inside the case ring in two rows each situated in a plane perpendicular to the axis of the axial fan and in which the two rows of blades rotate in opposite directions by virtue of two coaxial shafts of the axial fan.

8. The axial ventilation device as claimed in claim 1, in which the external ends of the two coaxial shafts of at least one axial fan are arranged respectively in an inlet bullet and in an outlet bullet and the internal ends of the two coaxial shafts are connected to the coupling device so as to allow them to rotate in two opposite directions.

9. The axial ventilation device as claimed in claim 1, in which the drive shaft of at least one axial fan passes through the motor longitudinally and extends to meet both a first axial fan and a second axial fan.

10. The axial ventilation device as claimed in claim 1, in which the polygon is chosen from the list consisting of a triangle, a square, a rectangle, a hexagon, an octagon.

11. The axial ventilation device as claimed in claim 1, in which each axial fan of the axial ventilation device is identical.

12. A premises equipped with at least one axial ventilation device as claimed in claim 1.

13. The use of an axial ventilation device as claimed in claim 1 for transferring energy, under very cold weather conditions, to a gas passing through said ventilation device.

14. An axial ventilation device comprising at least three axial fans arranged at the ends of a polygon, in which each axial fan comprises a case ring exhibiting symmetry of revolution extending longitudinally along an axis of the fan, a plurality of blades arranged inside the case ring and fixed to a hub, a shaft of the axial fan to which the hub is secured, the hub of at least one axial fan is driven by two motors, the axes of rotation of which are arranged in one and the same plane perpendicular to the axis of the axial fan, said shaft extending along the axis of the axial fan, at least one motor designed to drive a drive shaft in rotation about the axis of rotation of said motor, in which the motor is situated on the outside of the case ring and the drive shaft is connected to the shaft of the axial fan by a coupling device so as to perform the rotary driving of the shaft of the axial fan, said axial ventilation device further characterized in that one and the same drive shaft is designed to drive the rotation of at least the shafts of two axial fans.

* * * * *